US009576532B2

(12) United States Patent
Lee

(10) Patent No.: US 9,576,532 B2
(45) Date of Patent: Feb. 21, 2017

(54) DISPLAY PANEL AND ORGANIC LIGHT-EMITTING DIODE DISPLAY INCLUDING THE SAME

(71) Applicant: Samsung Display Co., Ltd., Yongin, Gyeonggi-Do (KR)

(72) Inventor: Seung-Kyu Lee, Asan-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 47 days.

(21) Appl. No.: 14/599,134

(22) Filed: Jan. 16, 2015

(65) Prior Publication Data

US 2015/0371606 A1 Dec. 24, 2015

(30) Foreign Application Priority Data

Jun. 23, 2014 (KR) ..... 10-2014-0076546

(51) Int. Cl.
*G09G 5/10* (2006.01)
*G09G 3/32* (2016.01)

(52) U.S. Cl.
CPC .... *G09G 3/3233* (2013.01); *G09G 2300/0852* (2013.01); *G09G 2300/0861* (2013.01); *G09G 2310/0251* (2013.01); *G09G 2320/0242* (2013.01)

(58) Field of Classification Search
CPC ..... G09G 2310/0251; G09G 2320/0242
See application file for complete search history.

(56) References Cited

U.S. PATENT DOCUMENTS

2007/0126680 A1* 6/2007 Han ..... G09G 3/3233 345/92
2008/0239901 A1 10/2008 Tsunokawa et al.
2009/0295772 A1 12/2009 Kim et al.
2011/0025678 A1* 2/2011 Chung ..... G09G 3/3233 345/213
2011/0063266 A1* 3/2011 Chung ..... G09G 3/3233 345/205

(Continued)

FOREIGN PATENT DOCUMENTS

KR 10-2006-0114477 A 11/2006
KR 10-2008-0087663 A 10/2008

(Continued)

*Primary Examiner* — Benjamin C Lee
*Assistant Examiner* — Dong Hui Liang
(74) *Attorney, Agent, or Firm* — Knobbe Martens Olson & Bear LLP

(57) ABSTRACT

A display panel and an organic light-emitting diode (OLED) display including the display panel are disclosed. The display panel includes a first pixel configured to emit a first color of light, a second pixel configured to emit a second color of light, and a third pixel configured to emit a third color of light. Each of the first to third pixels includes a light emission current applying unit including a driving transistor and a storage capacitor, a gate electrode of the driving transistor configured to receive a data signal from a display driver of the OLED display. The panel includes a light emission unit configured to emit light based on a light emission current. The panel also includes an initialization voltage supply unit configured to provide an initialization voltage to the gate electrode of the driving transistor and the first electrode of the OLED.

21 Claims, 8 Drawing Sheets

(56) References Cited

U.S. PATENT DOCUMENTS

| | | | | |
|---|---|---|---|---|
| 2011/0316892 | A1* | 12/2011 | Sung | G09G 3/3233 345/690 |
| 2012/0001896 | A1* | 1/2012 | Han | G09G 3/3233 345/214 |
| 2013/0043803 | A1* | 2/2013 | Raj | H05B 33/0896 315/241 R |
| 2013/0088482 | A1* | 4/2013 | Nathan | G09G 3/3233 345/212 |
| 2014/0035799 | A1 | 2/2014 | Bae et al. | |

FOREIGN PATENT DOCUMENTS

| | | | |
|---|---|---|---|
| KR | 10-2009-0123562 | A | 12/2009 |
| KR | 10-2014-0017738 | A | 2/2014 |

* cited by examiner

DISPLAY PANEL AND ORGANIC LIGHT-EMITTING DIODE DISPLAY INCLUDING THE SAME

CROSS-REFERENCE TO RELATED APPLICATIONS

This application claims priority under 35 USC §119 to Korean Patent Application No. 10-2014-0076546, filed on Jun. 23, 2014 in the Korean Intellectual Property Office (KIPO), the contents of which are incorporated herein in its entirety by reference.

BACKGROUND

Field

The described technology generally relates to a pixel, a display panel, and an organic light-emitting diode (OLED) display including the display panel.

Description of the Related Technology

An OLED display can control OLEDs to display images. An electrode of the OLED (e.g., anode) can be initialized by an initial voltage at every frame. As the initialized voltage difference between two electrodes of the OLED increases to a threshold voltage or more to emit light, a parasitic capacitor of the OLED is charged to a specific amount (Q=CV) to have a voltage difference between the two electrodes greater than the threshold voltage. In addition, a green color OLED (i.e., an OLED that emits green color light) generally has higher light emission efficiency than a red color OLED (i.e., an OLED that emits red color light) or a blue color OLED (i.e., an OLED that emits blue color light) such that the green color OLED can have a similar brightness to the other colors using less current. The green color OLED can have less trigger current and greater parasitic capacitance than the red OLED or blue OLED.

SUMMARY OF CERTAIN INVENTIVE ASPECTS

One inventive aspect is a display panel of an organic light-emitting diode (OLED) display that can prevent a color-shifting phenomenon.

Another aspect is an OLED display that can prevent a color-shifting phenomenon.

Another aspect is a pixel of an OLED display that can prevent the color-shifting phenomenon.

Another aspect is a display panel included in an OLED display that includes a first pixel configured to emit first color light of primary colors, a second pixel configured to emit second color light of the primary colors, and a third pixel configured to emit third color light of the primary colors. Here, each of the first pixel, the second pixel, and the third pixel can include a light emission unit configured to emit light based on a light emission current, the light emission unit including an OLED that includes a first electrode connected to a light emission current applying unit and a second electrode connected to a first power supply voltage, the light emission current applying unit configured to apply the light emission current to the light emission unit, the light emission current applying unit including a driving transistor that determines an amount of the light emission current based on a voltage level of a data signal applied to a gate electrode of the driving transistor and a storage capacitor that maintains the voltage level of the data signal during a predetermined time, and an initialization voltage supply unit configured to provide an initialization voltage to the gate electrode of the driving transistor and the first electrode of the OLED. In addition, each of the first pixel and the second pixel can further include a boost capacitor connected between the gate electrode of the driving transistor and the first electrode of the OLED.

In example embodiments, the first pixel is a red color pixel that emits red color light, and the second pixel can be a blue color pixel that emits blue color light.

In example embodiments, the boost capacitor boosts a voltage level of the gate electrode of the driving transistor by a change of a voltage level of the first electrode of the OLED.

In example embodiments, the light emission unit does not emit light while the storage capacitor maintains a voltage level for displaying black color corresponding to a (0)th gray-level.

In example embodiments, the light emission unit further includes a parallel-to-diode capacitor connected between the first electrode of the OLED and the second electrode of the OLED.

In example embodiments, the parallel-to-diode capacitor is a parasitic capacitor between the first electrode of the OLED and the second electrode of the OLED.

In example embodiments, the light emission current applying unit applies the data signal to the gate electrode of the driving transistor when a scan signal is activated, and applies the light emission current to the light emission unit when a light emission signal is activated.

In example embodiments, the light emission current applying unit includes the driving transistor, the storage capacitor connected between a second power supply voltage and the gate electrode of the driving transistor, a data applying transistor including a gate electrode to which the scan signal is applied, a first electrode to which the data signal is applied, and a second electrode connected to a first electrode of the driving transistor, a voltage compensation transistor including a gate electrode to which the scan signal is applied, a first electrode connected to a second electrode of the driving transistor, and a second electrode connected to the gate electrode of the driving transistor, a first light emission control transistor including a gate electrode to which the light emission signal is applied, a first electrode connected to the second power supply voltage, and a second electrode connected to the first electrode of the driving transistor, and a second light emission control transistor including a gate electrode to which the light emission signal is applied, a first electrode connected to the second electrode of the driving transistor, and a second electrode connected to the light emission unit.

In example embodiments, the light emission current applying unit includes the driving transistor of which a second electrode is connected to a second power supply voltage, the storage capacitor connected between the second power supply voltage and the gate electrode of the driving transistor, a data applying transistor including a gate electrode to which the scan signal is applied, a first electrode to which the data signal is applied, and a second electrode connected to the gate electrode of the driving transistor, and a voltage compensation transistor including a gate electrode to which the scan signal is applied, a first electrode connected to a second electrode of the driving transistor, and a second electrode connected to the gate electrode of the driving transistor, a light emission control transistor including a gate electrode to which the light emission signal is applied, a first electrode connected to a first electrode of the driving transistor, and a second electrode connected to the light emission unit.

In example embodiments, the initialization voltage supply unit provides the initialization voltage to the gate electrode of the driving transistor when a gate initialization signal is activated, and provides the initialization voltage to the first electrode of the OLED when a diode initialization signal is activated.

In example embodiments, the initialization voltage supply unit includes a gate initialization transistor including a gate electrode to which the gate initialization signal is applied, a first electrode connected to the initialization voltage, and a second electrode connected to the gate electrode of the driving transistor, and a diode initialization transistor including a gate electrode to which the diode initialization signal is applied, a first electrode connected to the initialization voltage, and a second electrode connected to the first electrode of the OLED.

Another aspect is an OLED display including a display panel, a data driving unit, a scan driving unit, a light emission driving unit, a timing control unit, and a power supply unit. Here, the display panel can include a first pixel that emits first color light of primary colors, a second pixel that emits second color light of the primary colors, and a third pixel that emits third color light of the primary colors. In addition, each of the first pixel, the second pixel, and the third pixel can include a light emission unit configured to emit light based on a light emission current, the light emission unit including an OLED that includes a first electrode connected to a light emission current applying unit and a second electrode connected to a first power supply voltage, the light emission current applying unit configured to apply the light emission current to the light emission unit, the light emission current applying unit including a driving transistor that determines an amount of the light emission current based on a voltage level of a data signal applied to a gate electrode of the driving transistor and a storage capacitor that maintains the voltage level of the data signal during a predetermined time, and an initialization voltage supply unit configured to provide an initialization voltage to the gate electrode of the driving transistor and the first electrode of the OLED. Further, each of the first pixel and the second pixel can further include a boost capacitor connected between the gate electrode of the driving transistor and the first electrode of the OLED.

In example embodiments, the first pixel is a red color pixel that emits red color light, and the second pixel is a blue color pixel that emits blue color light.

In example embodiments, the boost capacitor boosts a voltage level of the gate electrode of the driving transistor by a change of a voltage level of the first electrode of the OLED.

In example embodiments, the light emission unit does not emit light while the storage capacitor maintains a voltage level for displaying black color corresponding to a (0)th gray-level.

In example embodiments, the light emission unit further includes a parallel-to-diode capacitor connected between the first electrode of the OLED and the second electrode of the OLED.

In example embodiments, the light emission current applying unit applies the data signal to the gate electrode of the driving transistor when a scan signal is activated, and applies the light emission current to the light emission unit when a light emission signal is activated.

In example embodiments, the light emission current applying unit includes the driving transistor, the storage capacitor connected between a second power supply voltage and the gate electrode of the driving transistor, a data applying transistor including a gate electrode to which the scan signal is applied, a first electrode to which the data signal is applied, and a second electrode connected to a first electrode of the driving transistor, a voltage compensation transistor including a gate electrode to which the scan signal is applied, a first electrode connected to a second electrode of the driving transistor, and a second electrode connected to the gate electrode of the driving transistor, a first light emission control transistor including a gate electrode to which the light emission signal is applied, a first electrode connected to the second power supply voltage, and a second electrode connected to the first electrode of the driving transistor, and a second light emission control transistor including a gate electrode to which the light emission signal is applied, a first electrode connected to the second electrode of the driving transistor, and a second electrode connected to the light emission unit.

In example embodiments, the initialization voltage supply unit provides the initialization voltage to the gate electrode of the driving transistor when a gate initialization signal is activated, and provides the initialization voltage to the first electrode of the OLED when a diode initialization signal is activated.

In example embodiments, the initialization voltage supply unit includes a gate initialization transistor including a gate electrode to which the gate initialization signal is applied, a first electrode connected to the initialization voltage, and a second electrode connected to the gate electrode of the driving transistor, and a diode initialization transistor including a gate electrode to which the diode initialization signal is applied, a first electrode connected to the initialization voltage, and a second electrode connected to the first electrode of the OLED.

Another aspect is a display panel for an organic light-emitting diode (OLED) display, the display panel comprising a first pixel configured to emit a first color of light, a second pixel configured to emit a second color of light, and a third pixel configured to emit a third color of light. Each of the first to third pixels includes a light emission current applying unit including a driving transistor and a storage capacitor, wherein a gate electrode of the driving transistor is configured to receive a data signal from a display driver of the OLED display. The panel also includes a light emission unit configured to emit light based at least in part on a light emission current, wherein the light emission unit includes an OLED including a first electrode electrically connected to the light emission current applying unit and a second electrode electrically connected to a first power supply voltage, wherein the light emission current applying unit is configured to apply the light emission current to the light emission unit, wherein the driving transistor of the light emission current applying unit is configured to determine an amount of the light emission current based at least in part on a voltage level of the data signal, and wherein the storage capacitor is configured to maintain the voltage level of the data signal for a predetermined time. The panel also includes an initialization voltage supply unit configured to provide an initialization voltage to the gate electrode of the driving transistor and the first electrode of the OLED, wherein each of the first and second pixels further includes a boost capacitor electrically connected between the gate electrode of the driving transistor and the first electrode of the OLED.

In the above panel, the first pixel includes a red pixel configured to emit red light, wherein the second pixel includes a blue pixel configured to emit blue light.

In the above panel, the boost capacitor is configured to boost a voltage level of the gate electrode of the driving transistor based on a change of a voltage level of the first electrode of the OLED.

In the above panel, the light emission unit is configured to not emit light while the storage capacitor maintains a voltage level for displaying black color corresponding to a (0)th gray-level.

In the above panel, the light emission unit further includes a parallel-to-diode capacitor electrically connected between the first and second electrodes of the OLED.

In the above panel, the parallel-to-diode capacitor includes a parasitic capacitor electrically connected between the first and second electrodes of the OLED.

In the above panel, the light emission current applying unit is further configured to apply i) the data signal to the gate electrode of the driving transistor when a scan signal is activated and ii) the light emission current to the light emission unit when a light emission signal is activated.

In the above panel, the light emission current applying unit further includes a data applying transistor including a gate electrode configured to receive the scan signal, a first electrode configured to receive the data signal, and a second electrode electrically connected to a first electrode of the driving transistor, wherein the storage capacitor is electrically connected between a second power supply voltage and the gate electrode of the driving transistor. In the above panel, the light emission current applying unit further includes a voltage compensation transistor including a gate electrode configured to receive the scan signal, a first electrode electrically connected to a second electrode of the driving transistor, and a second electrode electrically connected to the gate electrode of the driving transistor. In the above panel, the light emission current applying unit further includes a first light emission control transistor including a gate electrode configured to receive the light emission signal, a first electrode electrically connected to the second power supply voltage, and a second electrode electrically connected to the first electrode of the driving transistor. In the above panel, the light emission current applying unit further includes a second light emission control transistor including a gate electrode configured to receive the light emission signal, a first electrode electrically connected to the second electrode of the driving transistor, and a second electrode electrically connected to the light emission unit.

In the above panel, the light emission current applying unit includes a data applying transistor including a gate electrode configured to receive the scan signal, a first electrode configured to receive the data signal, and a second electrode electrically connected to the gate electrode of the driving transistor, wherein a second electrode of the driving transistor is electrically connected to a second power supply voltage, and wherein the storage capacitor is electrically connected between the second power supply voltage and the gate electrode of the driving transistor. In the above panel, the light emission current applying unit also includes a voltage compensation transistor including a gate electrode configured to receive the scan signal, a first electrode electrically connected to a second electrode of the driving transistor, and a second electrode electrically connected to the gate electrode of the driving transistor. In the above panel, the light emission current applying unit also includes a light emission control transistor including a gate electrode configured to receive the light emission signal, a first electrode electrically connected to a first electrode of the driving transistor, and a second electrode electrically connected to the light emission unit.

In the above panel, the initialization voltage supply unit is further configured to provide i) the initialization voltage to the gate electrode of the driving transistor when a gate initialization signal is activated and ii) the initialization voltage to the first electrode of the OLED when a diode initialization signal is activated.

In the above panel, the initialization voltage supply unit includes a gate initialization transistor including a gate electrode configured to receive the gate initialization signal, a first electrode electrically connected to the initialization voltage, and a second electrode electrically connected to the gate electrode of the driving transistor. In the above panel, the light emission current applying unit also includes a diode initialization transistor including a gate electrode configured to receive the diode initialization signal, a first electrode electrically connected to the initialization voltage, and a second electrode electrically connected to the first electrode of the OLED.

Another aspect is an OLED display comprising a display panel including first to third pixels configured to respectively emit first to third colors of light, a data driver configured to transmit a plurality of data signals to the display panel, a scan driver configured to transmit a plurality of scan signals to the display panel, a light emission driver configured to transmit a plurality of light emission signals to the display panel, and a timing controller configured to control the data driver, the scan driver, and the light emission driver. Each of the first to third pixels includes a light emission current applying unit including a driving transistor and a storage capacitor, wherein a gate electrode of the driving transistor is configured to receive a data signal from a display driver of the OLED display. Each of the first to third pixels also includes a light emission unit configured to emit light based at least in part on a light emission current, wherein the light emission unit includes an OLED including a first electrode electrically connected to the light emission current applying unit and a second electrode electrically connected to a first power supply voltage, wherein the light emission current applying unit is configured to apply the light emission current to the light emission unit, wherein the driving transistor of the light emission current applying unit is configured to determine an amount of the light emission current based at least in part on a voltage level of the data signal, and wherein the storage capacitor is configured to maintain the voltage level of the data signal for a predetermined time. Each of the first to third pixels also includes an initialization voltage supply unit configured to provide an initialization voltage to the gate electrode of the driving transistor and the first electrode of the OLED, wherein each of the first and second pixels further includes a boost capacitor electrically connected between the gate electrode of the driving transistor and the first electrode of the OLED.

In the above display, the first pixel includes a red pixel configured to emit red light, and wherein the second pixel includes a blue pixel configured to emit blue light.

In the above display, the boost capacitor is configured to boost a voltage level of the gate electrode of the driving transistor based on a change of a voltage level of the first electrode of the OLED.

In the above display, the light emission unit is configured to not emit light while the storage capacitor maintains a voltage level for displaying black color corresponding to a (0)th gray-level.

In the above display, the light emission unit further includes a parallel-to-diode capacitor electrically connected between the first and second electrodes of the OLED.

In the above display, the light emission current applying unit is further configured to apply i) the data signal to the gate electrode of the driving transistor when a selected scan signal is activated, and ii) the light emission current to the light emission unit when a light emission signal is activated.

In the above display, the light emission current applying unit further includes a data applying transistor including a gate electrode configured to receive the selected scan signal, a first electrode configured to receive the data signal is applied, and a second electrode electrically connected to a first electrode of the driving transistor, wherein the storage capacitor is electrically connected between a second power supply voltage and the gate electrode of the driving transistor. In the above display, the light emission current applying unit further includes a voltage compensation transistor including a gate electrode configured to receive the selected scan signal, a first electrode electrically connected to a second electrode of the driving transistor, and a second electrode electrically connected to the gate electrode of the driving transistor. In the above display, the light emission current applying unit further includes a first light emission control transistor including a gate electrode configured to receive the light emission signal, a first electrode electrically connected to the second power supply voltage, and a second electrode electrically connected to the first electrode of the driving transistor. In the above display, the light emission current applying unit further includes a second light emission control transistor including a gate electrode configured to receive the light emission signal, a first electrode electrically connected to the second electrode of the driving transistor, and a second electrode electrically connected to the light emission unit.

In the above display, the initialization voltage supply unit is further configured to provide i) the initialization voltage to the gate electrode of the driving transistor when a gate initialization signal is activated and ii) the initialization voltage to the first electrode of the OLED when a diode initialization signal is activated.

In the above display, the initialization voltage supply unit includes a gate initialization transistor including a gate electrode configured to receive the gate initialization signal, a first electrode electrically connected to the initialization voltage, and a second electrode electrically connected to the gate electrode of the driving transistor. In the above display, the initialization voltage supply unit further includes a diode initialization transistor including a gate electrode configured to receive the diode initialization signal, a first electrode electrically connected to the initialization voltage, and a second electrode electrically connected to the first electrode of the OLED.

According to at least one of the disclosed embodiments, an OLED display, a display panel of an OLED display, and a pixel of an OLED display can substantially simultaneously (or, concurrently) turn on OLEDs included in the display panel by including a boost capacitor which boosts a voltage level of a gate electrode of a driving transistor. Thus, a color-shifting phenomenon can be prevented.

DETAILED DESCRIPTION OF CERTAIN INVENTIVE EMBODIMENTS

Figure 1:
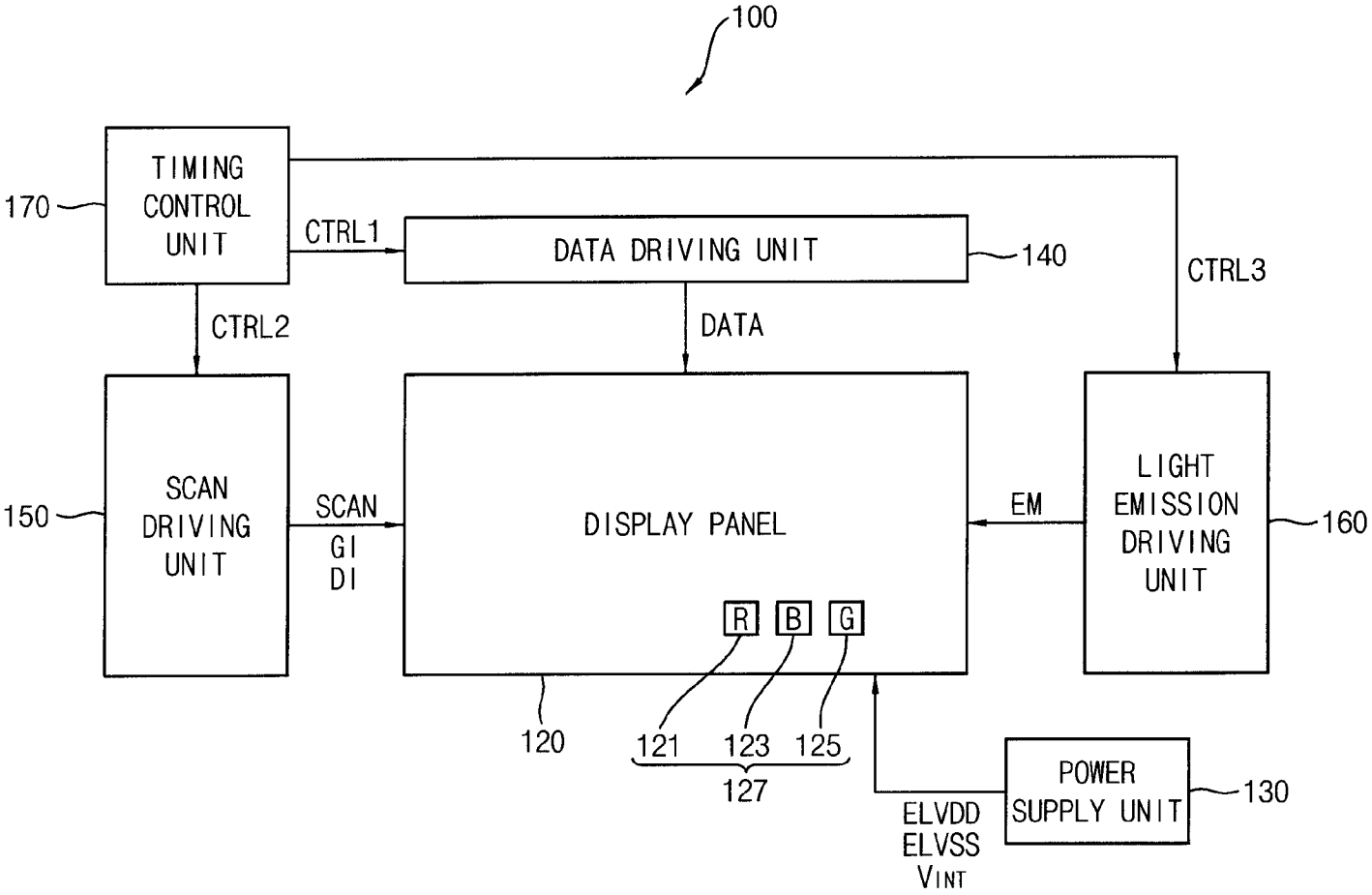
FIG. 1 is a block diagram illustrating an OLED display according to example embodiments.

When an OLED display changes its lighting output from black to white, the required magnitude of charge for the voltage difference between the two electrodes of a green OLED can be greater than that of a red OLED or a blue OLED. However, a current flowing through the green OLED is less than a current flowing through the red OLED or the blue OLED. Thus, when the green OLED is turned on after the red or blue OLED, a color-shift can occur where the white on the display is somewhat shifted to have a purple image.

Various example embodiments will be described more fully with reference to the accompanying drawings, in which some example embodiments are shown. The present inventive concept can, however, be embodied in many different forms and should not be construed as limited to the embodiments set forth herein. Rather, these embodiments are provided so that this disclosure will be thorough and complete, and will fully convey the scope of the present inventive concept to those skilled in the art. Like reference numerals refer to like elements throughout this application.

It will be understood that, although the terms first, second, etc. can be used herein to describe various elements, these elements should not be limited by these terms. These terms are used to distinguish one element from another. For example, a first element could be termed a second element, and, similarly, a second element could be termed a first element, without departing from the scope of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements can be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments and is not intended to be limiting of the inventive concept. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. In this disclosure, the term "substantially" includes the meanings of completely, almost completely or to any significant degree under some applications and in accordance with those skilled in the art. Moreover, "formed on" can also mean "formed over." The term "connected" can include an electrical connection.

FIG. 1 is a block diagram illustrating an OLED display according to example embodiments.

Referring to FIG. 1, the OLED display 100 includes a display panel 120, a data driving unit or a data driver 140, a scan driving unit or a scan driver 150, a light emission driving unit or a light emission driver 160, a timing control unit or a timing controller 170, and a power supply unit 130.

The display panel 120 can include a first pixel 121 emitting first color light of the primary colors, a second pixel 123 emitting second color light of the primary colors, and a third pixel 125 emitting third color light of the primary colors.

The first to third pixels 121, 123 and 125 can include a light emission unit, a light emission current applying unit, and an initialization voltage supply unit, respectively. Here, the light emission unit can include an OLED, and the light emission current applying unit can include a driving transistor and a storage capacitor. The first pixel 121 and second pixel 123 can include a boost capacitor connected between a gate electrode of the driving transistor and a first electrode of the OLED. In example embodiments, the first pixel 121 is a red color pixel (R) emitting red color light, the second pixel can be a blue color pixel (B) emitting blue color light, and the third pixel can be a green color pixel (G) emitting green color light. In example embodiments, the boost capacitor boosts the voltage level of the gate electrode of the driving transistor by the change of the voltage level of the first electrode of the OLED. The OLEDs included in the pixels 127 can be substantially simultaneously turned on by boosting the voltage level of the gate electrode of the driving transistor by the boost capacitor. Thus, the color-shifting phenomenon can be prevented. Hereinafter, a structure and an operation of the pixels 127 boosted by the boost capacitor will be described in detail with reference to FIGS. 2 through 8.

The power supply unit 130 can generate a first power supply voltage ELVSS, a second power supply voltage ELVDD, and an initialization voltage VINT. The power supply unit 130 can provide the first power supply voltage ELVSS, the second power supply voltage ELVDD, and the initialization voltage VINT to the pixels 127.

The data driving unit 140 can provide a data signal DATA to the pixels 127. The brightness of the light emitted by the pixels 127 can be determined based at least in part on the data signal DATA. The scan driving unit 150 can provide a scan signal SCAN, a gate initialization signal GI, and a diode initialization signal DI to the pixels 127. The light emission driving unit 160 can provide a light emission signal EM to the pixels 127.

The scan signal SCAN can be activated during a predetermined horizontal time and the data signal DATA can be provided to the pixels 127 when the scan signal SCAN is activated.

The gate initialization signal GI can be activated during a predetermined horizontal time, and the voltage level of the gate electrode of the driving transistor included in the pixels 127 can be initialized to the initialization voltage VINT when the gate initialization signal GI is activated. In example embodiments, the gate initialization signal GI provided to the (N)th row of the pixels 127, where N is an integer greater than or equal to 2, is the scan signal SCAN provided to the (N−1)th row of the pixels 127. For example, the activated gate initialization signal GI is provided to the (N)th row of the pixels 127 by providing the activated scan signal SCAN to the (N−1)th row of the pixels. As a result, the gate electrode of the driving transistor of the (N)th row of the pixels 127 can be initialized while providing the data signal DATA to the (N−1)th row of the pixels 127.

The diode initialization signal DI can be activated during a predetermined horizontal time, and the voltage level of an electrode of the OLED included in the pixels 127 can be initialized to the initialization voltage VINT when the diode initialization signal DI is activated.

The light emission signal EM can be activated during a predetermined horizontal time, and the OLED included in the pixels 127 can emit light when the light emission signal EM is activated.

The activation voltage level of the scan signal SCAN, the gate initialization signal GI, the diode initialization signal DI, and the light emission signal EM can be higher than the deactivation voltage level when the pixels 127 include an N-channel Metal Oxide Semiconductor (NMOS) transistors. In contrast, the activation voltage level of the scan signal SCAN, the gate initialization signal GI, the diode initialization signal DI, and the light emission signal EM can be lower than the deactivation voltage level when the pixels 127 include P-channel Metal Oxide Semiconductor (PMOS) transistors.

The timing control unit 170 can control the timing of the data signal DATA provided by the data driving unit 140 based at least in part on the first control signal CTRL1, the timing of the scan signal SCAN provided by the scan driving unit 150 based at least in part on the second control signal CTRL2, and the timing of the light emission signal EM provided by the light emission driving unit 160 based at least in part on the third control signal CTRL3.

Example timings of the scan signal SCAN, the gate initialization signal GI, the diode initialization signal DI, and the light emission signal EM will be described in detail with reference to FIG. 6.

Figure 2:
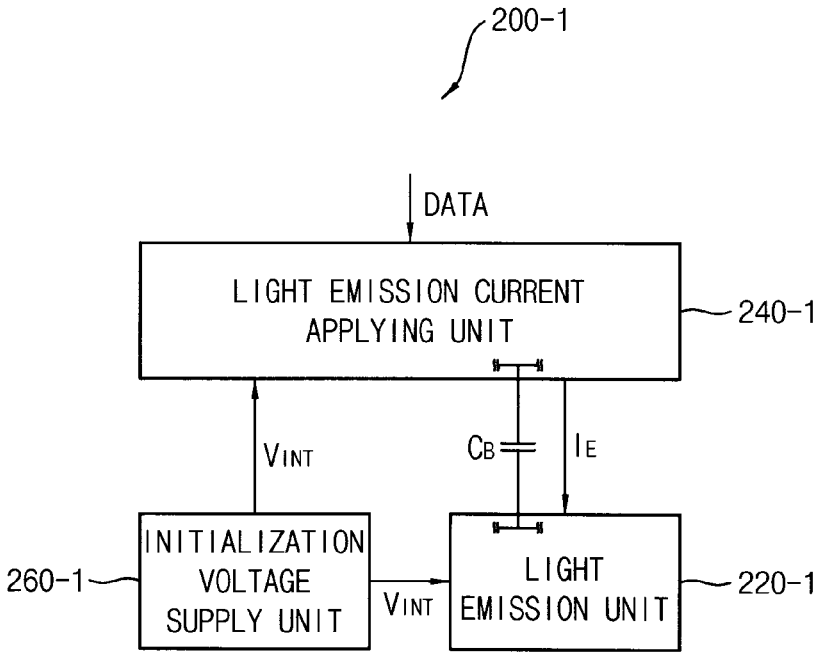
FIG. 2 is a block diagram illustrating a first structure of a pixel included in the OLED display of FIG. 1.

FIG. 2 is a block diagram illustrating a first structure of a pixel included in the OLED display 100 of FIG. 1.

Referring to FIG. 2, the first structure 200-1 includes a light emission unit 220-1, a light emission current applying unit 240-1, and an initialization voltage supply unit 260-1. In addition, the first structure 200-1 can also include a boost capacitor CB. The first pixel 121 and the second pixel 123 of FIG. 1 can have the first structure 200-1.

The light emission unit 220-1 can include the OLED which emits light based at least in part on a light emission current IE. In example embodiments, the light emission unit 220-1 also includes a parallel-to-diode capacitor (i.e., a capacitor that is parallel to the OLED).

The light emission current applying unit 240-1 can include the driving transistor and the storage capacitor, and can apply the light emission current IE to the light emission unit 220-1. At this time, the driving transistor can determine the amount of the light emission current IE based at least in part on the data signal DATA applied to the gate electrode, and the storage capacitor can maintain the voltage level of the data signal DATA applied to the gate electrode of the driving transistor during a predetermined time. In example embodiments, the light emission current applying unit 240-1 applies the data signal DATA to the gate electrode of the driving transistor when the scan signal is activated, and applies the light emission current IE to the light emission unit 220-1 when the light emission signal is activated.

The initialization voltage supply unit 260-1 can provide the initialization voltage VINT to the gate electrode of the driving transistor and the first electrode of the OLED. In example embodiments, the initialization voltage supply unit 260-1 provides the initialization voltage VINT to the gate electrode of the driving transistor when the gate initialization signal is activated, and provides the initialization voltage VINT to the first electrode of the OLED when the diode initialization signal is activated.

The boost capacitor CB can be connected between the gate electrode of the driving transistor of the light emission current applying unit 240-1 and the first electrode of the OLED of the light emission unit 220-1. The boost capacitor CB can boost the voltage level of the gate electrode of the driving transistor by the change of the voltage level of the first electrode of the OLED. The OLED in the first structure 200-1 and the OLED in the second structure can be substantially simultaneously turned on by boosting the voltage level of the gate electrode of the driving transistor by the boost capacitor CB. Thus, the color-shifting phenomenon can be prevented.

In example embodiments, all pixels included in the display panel have the first structure 200-1. The boost duration of the pixels can vary based at least in part on the capacitance of the boost capacitors CB varied from pixel to pixel depending on their turn-on property. For example, the boost duration is controlled by controlling the capacitance of the boost capacitor CB. As a result, the light emitting timings of the OLEDs included in the pixels can be controlled, and the OLEDs can be substantially simultaneously turned on when the light emitting timings of the pixels are synchronized. Thus, the color-shifting phenomenon can be prevented.

Figure 3:
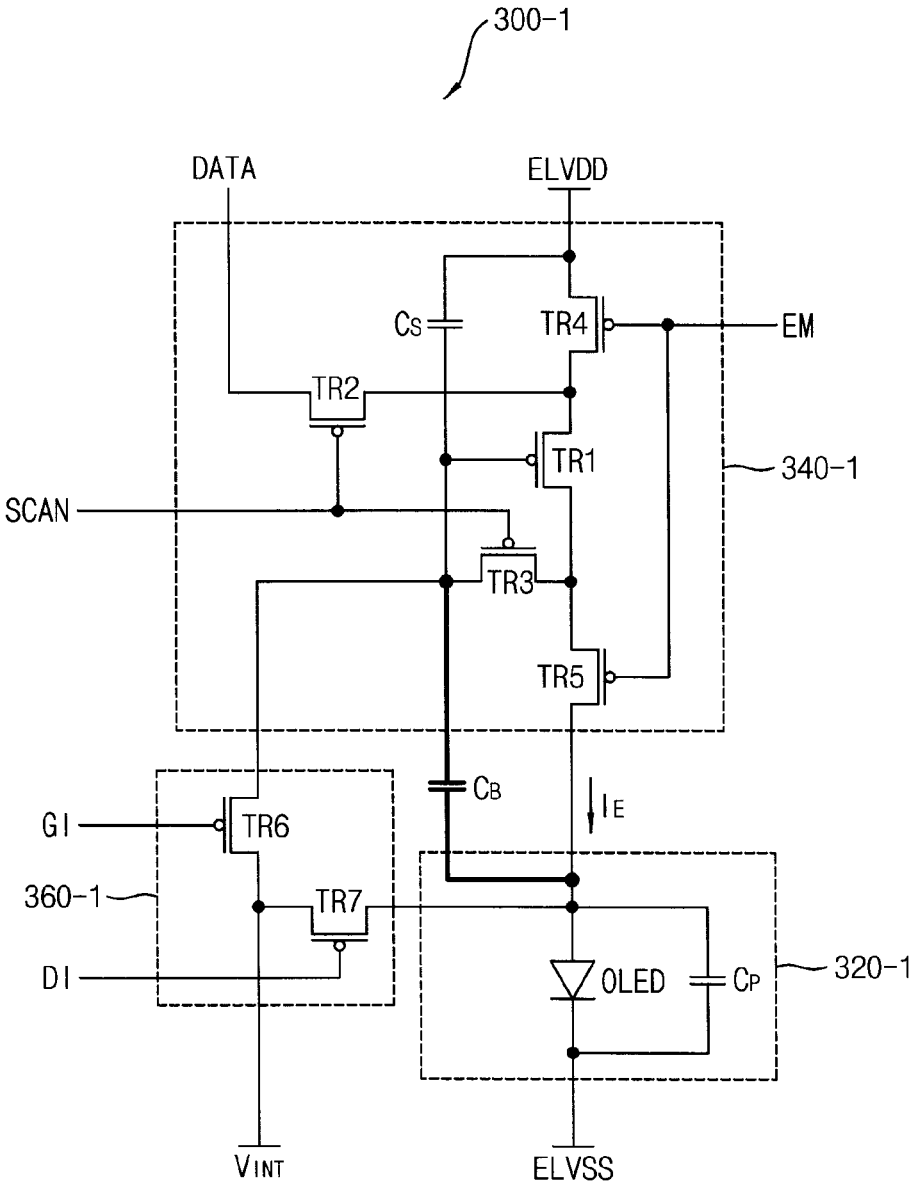
FIG. 3 is a circuit diagram illustrating an example of the first structure of FIG. 2.

FIG. 3 is a circuit diagram illustrating an example of the first structure of FIG. 2.

Referring to FIG. 3, the first structure 300-1 includes a light emission unit 320-1, a light emission current applying unit 340-1, and an initialization voltage supply unit 360-1. The first structure 300-1 can also include the boost capacitor CB.

The light emission unit 320-1 can include an OLED which emits light based at least in part on a light emission current IE. Here, the OLED can include a first electrode connected to the light emission current applying unit 340-1 and a second electrode connected to a first power supply voltage ELVSS. In example embodiments, the light emission unit 320-1 does not emit light while the storage capacitor CS maintains a voltage level for displaying black color corresponding to the (0)th gray-level.

In example embodiments, the light emission unit 320-1 also includes a parallel-to-diode capacitor CP connected between the first electrode of the OLED and the second electrode of the OLED. In example embodiments, the parallel-to-diode capacitor CP is a parasitic capacitor between the first and second electrodes of the OLED.

The light emission current applying unit 340-1 can apply the light emission current IE to the light emission unit 320-1. The light emission current applying unit 340-1 can include a driving transistor TR1, a storage capacitor CS, a data applying transistor TR2, a voltage compensation transistor TR3, a first light emission control transistor TR4, and a second light emission control transistor TR5. Here, the driving transistor TR1 can include a gate electrode, a first electrode, and a second electrode, and the storage capacitor CS can be connected between a second power supply voltage ELVDD and a gate electrode of the driving transistor TR1. The data applying transistor TR2 can include a gate electrode to which the scan signal SCAN is applied, a first electrode to which the data signal DATA is applied, and a second electrode connected to the first electrode of the driving transistor TR1. The voltage compensation transistor TR3 can include a gate electrode to which the scan signal SCAN is applied, a first electrode connected to the second electrode of the driving transistor TR1, and a second electrode connected to the gate electrode of the driving transistor TR1. The first light emission control transistor TR4 can include a gate electrode to which the light emission signal EM is applied, a first electrode to which the second power supply voltage ELVDD is supplied, and a second electrode connected to the first electrode of the driving transistor TR1. The second light emission control transistor TR5 can include a gate electrode to which the light emission signal EM is applied, a first electrode connected to the second electrode of the driving transistor TR1, and a second electrode connected to the light emission unit 320-1.

The initialization voltage supply unit 360-1 can provide the initialization voltage VINT to the gate electrode of the driving transistor TR1 and the first electrode of the OLED. The initialization voltage supply unit 360-1 can include a gate initialization transistor TR6 and a diode initialization transistor TR7. Here, the gate initialization transistor TR6 can include a gate electrode to which a gate initialization signal GI is applied, a first electrode connected to the initialization voltage VINT, and a second electrode connected to the gate electrode of the driving transistor TR1. The diode initialization transistor TR7 can include a gate electrode to which the diode initialization signal DI is applied, a first electrode connected to the initialization voltage VINT, and a second electrode connected to the first electrode of the OLED.

The boost capacitor CB can be connected between the gate electrode of the driving transistor TR1 and the first electrode of the OLED. The boost capacitor CB can boost the voltage level of the gate electrode of the driving transistor TR1 by the change of the voltage level of the first electrode of the OLED.

Figure 4:
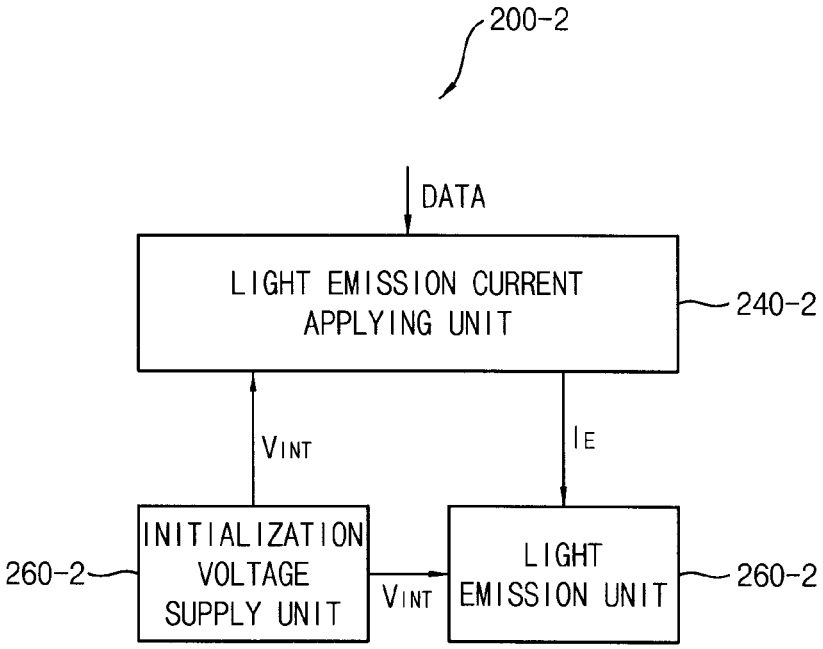
FIG. 4 is a block diagram illustrating a second structure of a pixel included in the OLED display of FIG. 1.

FIG. 4 is a block diagram illustrating a second structure of a pixel included in the OLED display 100 of FIG. 1.

Referring to FIG. 4, the second structure 200-2 includes a light emission unit 220-2, a light emission current applying unit 240-2, and an initialization voltage supply unit 260-2. The third pixel 125 of FIG. 1 can have the second structure 200-2.

The light emission unit 220-2 can include the OLED which emits light based at least in part on a light emission current IE. In example embodiments, the light emission unit 220-2 also includes a parallel-to-diode capacitor (i.e., a capacitor that is parallel to the OLED).

The light emission current applying unit 240-2 can include the driving transistor and the storage capacitor, and can apply the light emission current IE to the light emission unit 220-2. At this time, the driving transistor can determine the amount of the light emission current IE based at least in part on the data signal DATA applied to the gate electrode, and the storage capacitor can maintain the voltage level of the data signal DATA applied to the gate electrode of the driving transistor during a predetermined time. In example embodiments, the light emission current applying unit 240-2 applies the data signal DATA to the gate electrode of the driving transistor when the scan signal is activated, and applies the light emission current IE to the light emission unit 220-2 when the light emission signal is activated.

The initialization voltage supply unit 260-2 can provide the initialization voltage VINT to the gate electrode of the driving transistor and the first electrode of the OLED. In example embodiments, the initialization voltage supply unit 260-2 provides the initialization voltage VINT to the gate electrode of the driving transistor when the gate initialization signal is activated, and provides the initialization voltage VINT to the first electrode of the OLED when the diode initialization signal is activated.

Figure 5:
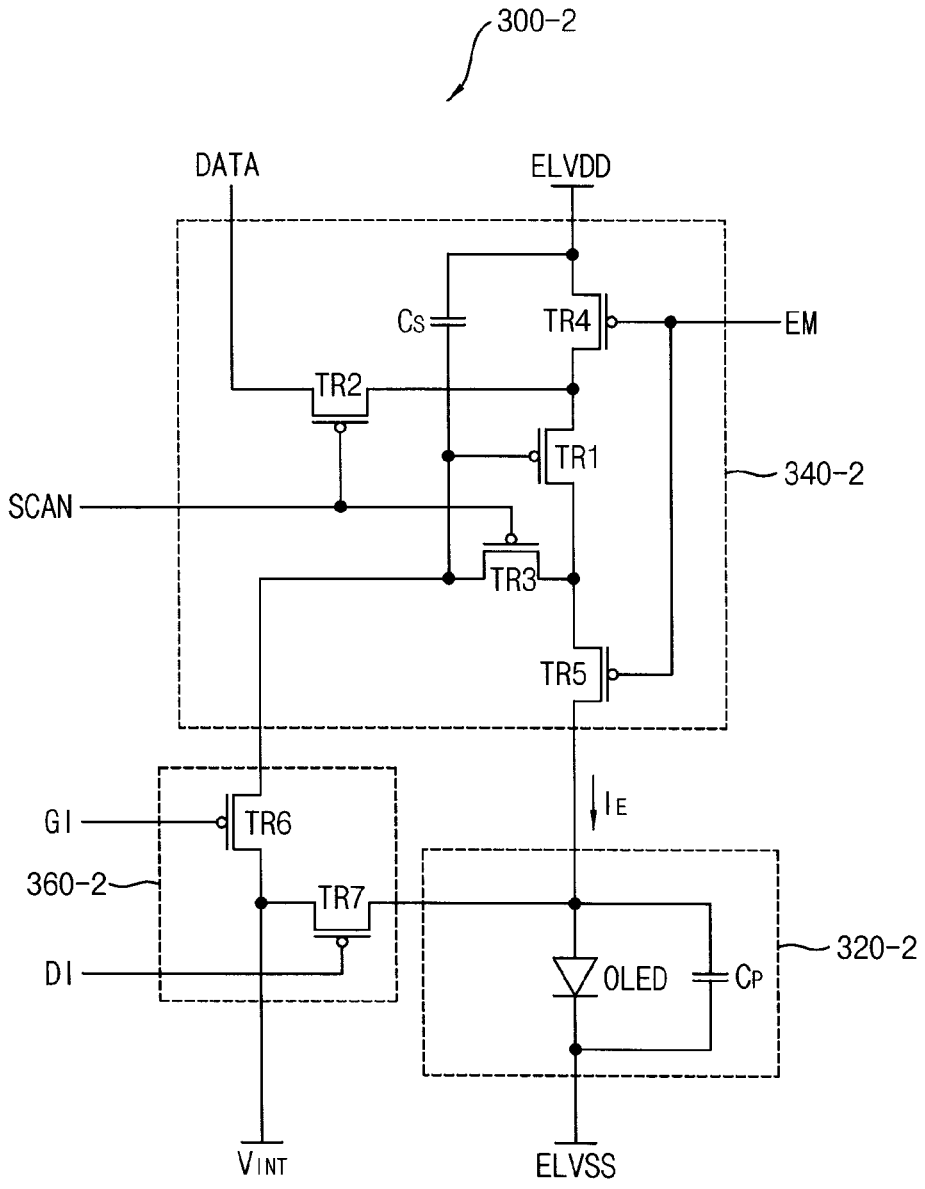
FIG. 5 is a circuit diagram illustrating an example of the second structure of FIG. 4.

FIG. 5 is a circuit diagram illustrating an example of the second structure of FIG. 4.

Referring to FIG. 5, the second structure 300-2 includes a light emission unit 320-2, a light emission current applying unit 340-2, and an initialization voltage supply unit 360-2.

The light emission unit 320-2 can include the OLED which emits light based at least in part on a light emission current IE. Here, the OLED can include a first electrode connected to the light emission current applying unit 340-2 and a second electrode connected to a first power supply voltage ELVSS. In example embodiments, the light emission unit 320-2 does not emit light while the storage capacitor CS maintains a voltage level for displaying black color corresponding to the (0)th gray-level.

In example embodiments, the light emission unit 320-2 also includes a parallel-to-diode capacitor CP connected between the first electrode of the OLED and the second electrode of the OLED. In example embodiments, the parallel-to-diode capacitor CP is a parasitic capacitor between the first and second electrodes of the OLED. The parasitic capacitance of the parallel-to-diode capacitor CP included in the second structure 300-2 can be smaller than the parasitic capacitance of the parallel-to-diode capacitor CP included in the first structure 300-1 of FIG. 3.

The light emission current applying unit 340-2 can apply the light emission current IE to the light emission unit 320-2. The light emission current applying unit 340-2 can include a driving transistor TR1, a storage capacitor CS, a data applying transistor TR2, a voltage compensation transistor TR3, a first light emission control transistor TR4, and a second light emission control transistor TR5. Here, the driving transistor TR1 can include a gate electrode, a first electrode, and a second electrode. The storage capacitor CS can be connected between a second power supply voltage ELVDD and a gate electrode of the driving transistor TR1. The data applying transistor TR2 can include a gate electrode to which the scan signal SCAN is applied, a first electrode to which the data signal DATA is applied, and a second electrode connected to the first electrode of the driving transistor TR1. The voltage compensation transistor TR3 can include a gate electrode to which the scan signal SCAN is applied, a first electrode connected to the second electrode of the driving transistor TR1, and a second electrode connected to the gate electrode of the driving transistor TR1. The first light emission control transistor TR4 can include a gate electrode to which the light emission signal EM is applied, a first electrode to which the second power supply voltage ELVDD is supplied, and a second electrode connected to the first electrode of the driving transistor TR1. The second light emission control transistor TR5 can include a gate electrode to which the light emission signal EM is applied, a first electrode connected to the second electrode of the driving transistor TR1, and a second electrode connected to the light emission unit 320-1.

The initialization voltage supply unit 360-2 can provide the initialization voltage VINT to the gate electrode of the driving transistor TR1 and the first electrode of the OLED. The initialization voltage supply unit 360-2 can include a gate initialization transistor TR6 and a diode initialization transistor TR7. Here, the gate initialization transistor TR6 can include a gate electrode to which a gate initialization signal GI is applied, a first electrode connected to the initialization voltage VINT, and a second electrode connected to the gate electrode of the driving transistor TR1. The diode initialization transistor TR7 can include a gate electrode to which the diode initialization signal DI is applied, a first electrode connected to the initialization voltage VINT, and a second electrode connected to the first electrode of the OLED.

Figure 6:
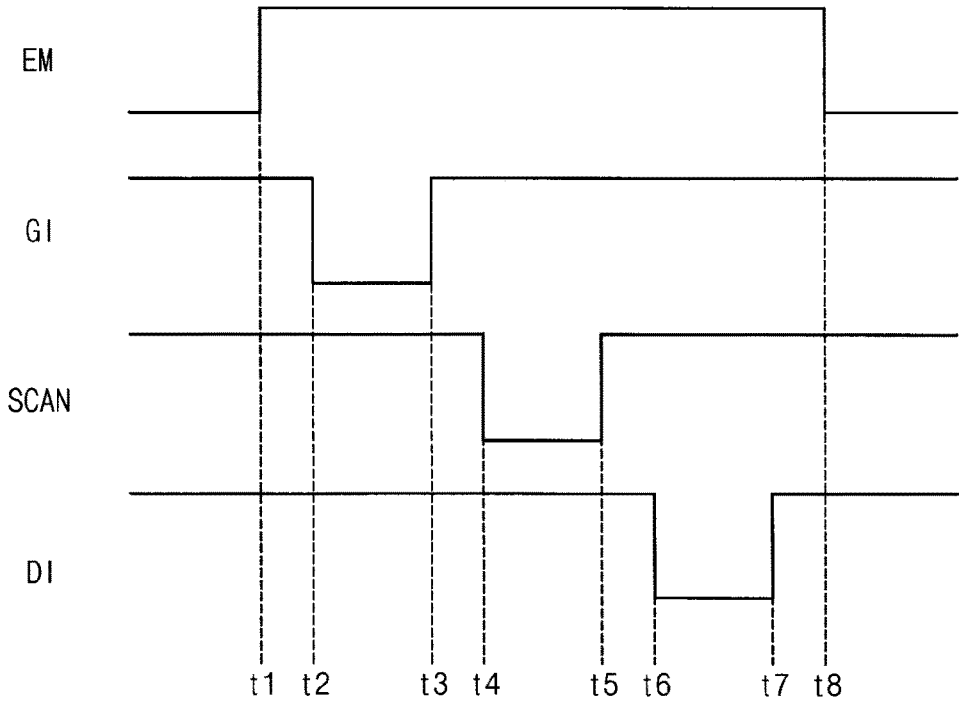
FIG. 6 is a timing diagram illustrating signals applied to the first structure of FIG. 3 and the second structure of FIG. 5.

FIG. 6 is a timing diagram illustrating signals applied to the first structure 300-1 of FIG. 3 and the second structure 300-2 of FIG. 5.

Referring to FIGS. 3, 5, and 6, the light emission signal EM has a deactivation period (i.e., between t1 and t8). The deactivation period (i.e., between t1 and t8) of the light emission signal EM can include an activation period (i.e., between t2 and t3) of the gate initialization signal GI, an activation period (i.e., between t4 and t5) of the scan signal SCAN, and an activation period (i.e., between t6 and t7) of the diode initialization signal DI. The gate initialization signal GI can be activated after deactivation of the light emission signal EM. The diode initialization signal DI can be activated after deactivation of the scan signal SCAN. Finally, the light emission signal EM can be activated after deactivation of the diode initialization signal DI.

The gate initialization signal GI can have the activation period (i.e., between t2 and t3) after the deactivation (i.e., t1) of the light emission signal EM. The gate initialization transistor TR6 can provide the initialization voltage VINT to the gate electrode of the driving transistor TR1. The voltage difference between the two electrodes of the storage capacitor CS can be initialized to a specific value ELVDD-VINT during the activation period (i.e., between t2 and t3) of the gate initialization signal GI.

The scan signal SCAN can have the activation period (i.e., between t4 and t5) after the deactivation (i.e., t3) of the gate initialization signal GI. The data applying transistor TR2 can apply the data signal DATA to the first electrode of the driving transistor TR1. The voltage compensation transistor TR3 can connect the second electrode and the gate electrode of the driving transistor TR1 during the activation period (i.e., between t4 and t5) of the scan signal SCAN. At this time, since the driving transistor is diode-connected, the voltage difference between the first and second electrodes can be as much as the threshold voltage of the driving transistor TR1. For example, the voltage level (i.e., the threshold voltage compensated data signal) that is lower than the voltage level of the data signal DATA applied to the first electrode of the driving transistor TR1 by the threshold voltage of the driving transistor TR1 is applied to the gate electrode of the driving transistor TR1. In addition, the storage capacitor CS can maintain the voltage level during a predetermined time. That is, the storage capacitor CS can maintain the voltage level of the threshold voltage compensated data signal DATA until the scan signal SCAN is reactivated (i.e., t4) during a next horizontal time.

The diode initialization signal DI can have the activation period (i.e., between t6 and t7) after the deactivation (i.e., t5) of the scan signal SCAN. The diode initialization transistor TR7 can provide the initialization voltage VINT to the first electrode of the OLED during the activation period (i.e., between t6 and t7) of the diode initialization signal DI.

The OLED can emit light when the voltage difference between the two electrodes of the OLED is greater than or equal to the threshold voltage. For example, the OLED emits light when the voltage difference between the two electrodes of the parallel-to-diode capacitor CP is greater than or equal to the threshold voltage. The parallel-to-diode capacitor CP should be charged to a specific amount for the OLED to be turned on because the voltage difference of the two electrodes of the parallel-to-diode capacitor CP is substantially proportional to the amount of charge of the parallel-to-diode capacitor CP (i.e., Q=CP×V). For example, the voltage difference between the two electrodes of the parallel-to-diode capacitor CP is generated as much as the threshold voltage by flowing the light emission current IE to the parallel-to-diode capacitor during a specific period (i.e., Q=IE×t) for the turned-off OLED to be turned on. As a result, the light emission current IE can flow through the OLED and cause the OLED to emit light.

Although the voltage level of the gate electrode of the driving transistor TR1 for displaying black color corresponding to the (0)th gray-level is maintained by the storage capacitor CS, a small amount of the light emission current IE can leak from the driving transistor TR1. For example, the driving transistor TR1 generates a leakage of the light emission current IE. For this reason, in order to display black color, a flowing of the light emission current IE through the OLED is required to be suppressed.

The parallel-to-diode capacitor CP can be connected to the OLED in parallel. Thus, the parallel-to-diode capacitor CP can bypass the light emission current IE during the activation period of the light emission signal EM. In addition, the voltage difference between the two electrodes of the parallel-to-diode capacitor CP can be lower than the threshold voltage during the activation period by initializing the voltage level of the first electrode of the OLED to the initialization voltage VINT at every frame. Thus, assuming a constant light emission current IE, the initialization voltage can be determined by the following [Equation 1].

$$VINT \leq ELVSS + Vth - \frac{IE \times t}{CP} \quad \text{Equation 1}$$

Here, Vth denotes the threshold voltage of the OLED, IE denotes the leakage light emission current, and t denotes the light emission time.

The light emission signal EM can be activated (i.e., t8) after deactivation (i.e., t7) of the diode initialization signal DI. When the light emission signal EM is activated (i.e., t8), the first light emission control transistor TR4 can connect the second power supply voltage ELVDD and the first electrode of the driving transistor TR1. When the light emission signal EM is activated (i.e., t8), the second light emission control transistor TR5 can connect the second electrode of the driving transistor TR1 and the first electrode of the OLED. As a result, the driving transistor TR1 can provide the light emission current IE which is determined based at least in part on the voltage level of the data signal DATA applied to the gate electrode to the light emission unit 320-1 and 320-2. Here, the voltage level of the data signal DATA can be the compensated voltage level generated by compensating the threshold voltage of the driving transistor TR1. At this time, the OLED of the light emission unit 320-1 and 320-2 can emit light based at least in part on the light emission current IE.

The boost capacitor CB can boost the voltage level of the gate electrode of the driving transistor TR1 by the change of the voltage level of the first electrode of the OLED. For example, since the light emission signal EM is deactivated at a time t1, the first electrode of the OLED maintains the voltage level of the previous frame when the OLED emits light. If the OLED displayed black color at the previous frame, the voltage level of the first electrode of the OLED can be a value less than the sum of the first power supply voltage ELVSS and the threshold voltage of the OLED. If the OLED emits light during the previous frame, the voltage level of the first electrode of the OLED can be a value greater than the sum of the first power supply voltage ELVSS and the threshold voltage of the OLED.

The data signal DATA of the current frame can be applied to the gate electrode of the driving transistor TR1 during the activation period (i.e., between t4 and t5) of the scan signal SCAN. Thus, the voltage difference between the two electrodes of the boost capacitor CB can be determined by the following [Equation 2].

$$VB = (\text{DATA} - Vth) - Vp \quad \text{Equation 2}$$

Here, VB denotes the voltage difference between the two electrodes of the boost capacitor CB, DATA denotes the voltage level of the data signal at the current frame, Vth denotes the threshold voltage of the driving transistor, and Vp denotes the voltage level of the first electrode of the OLED at the previous frame.

When the light emission signal EM is activated (i.e., t8), the light emission current IE based at least in part on the data signal DATA at the current frame can flow through the OLED, and the voltage difference between the two electrodes of the OLED substantially the same as the light emission current IE can be generated. In some embodiments, the voltage level of the first electrode of the OLED at the current frame is determined.

If the voltage level of the current frame is not equal to the voltage level of the previous frame at the first electrode of the OLED included in the first structure 300-1, the voltage level of the gate electrode of the driving transistor TR1 can be boosted by the boost capacitor CB. If the OLED was turned-off at the previous frame, and the OLED is turned-on at the current frame, the voltage level of the first electrode of the OLED can rise higher than the voltage level at the previous frame, and the voltage level of the gate electrode of the driving transistor TR1 can also rise by the boost capacitor CB. As a result, the amount of the light emission current IE determined by the driving transistor TR1 can be decreased. For example, the OLEDs included in the first and second structures 300-1 and 300-2 can be substantially simultaneously turned on. Thus, the color-shifting phenomenon can be prevented.

However, the change of the voltage level by the above-described boost operation can disappear after enough time has elapsed because the above-described boost operation is temporary. Thus, in some embodiments, the above-described boost operation does not influence the brightness of the OLED. Meanwhile, the duration of the above-described boost operation can be controlled by the capacitance of the boost capacitor CB.

Figure 7:
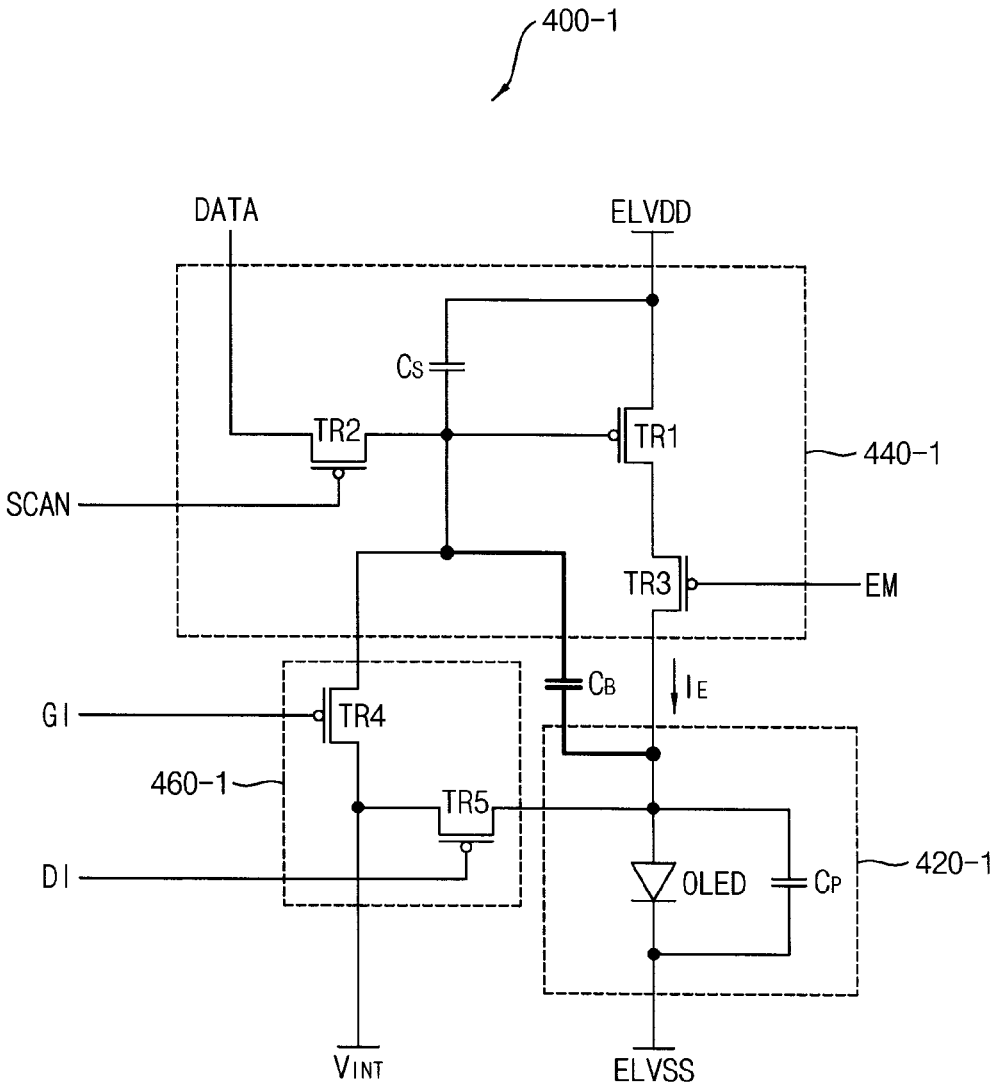
FIG. 7 is a circuit diagram illustrating another example of the first structure of FIG. 1.

FIG. 7 is a circuit diagram illustrating another example of the first structure 200-1 of FIG. 2.

Referring to FIG. 7, the first structure 400-1 includes a light emission unit 420-1, a light emission current applying unit 440-1, and an initialization voltage supply unit 460-1. The first structure 400-1 can also include the boost capacitor CB.

The light emission unit 420-1 can include an OLED which emits light based at least in part on a light emission current IE. Here, the OLED can include a first electrode connected to the light emission current applying unit 440-1 and a second electrode connected to a first power supply voltage ELVSS. In example embodiments, the light emission unit 420-1 also includes a parallel-to-diode capacitor CP connected between the first and second electrodes of the OLED.

The light emission current applying unit 440-1 can apply the light emission current IE to the light emission unit 420-1. The light emission current applying unit 440-1 can include a driving transistor TR1, a storage capacitor CS, a data applying transistor TR2, and a light emission control transistor TR3. Here, the driving transistor TR1 can include a gate electrode, a first electrode, and a second electrode connected to a second power supply voltage ELVDD. The storage capacitor CS can be connected between a second power supply voltage ELVDD and a gate electrode of the driving transistor TR1. The data applying transistor TR2 can include a gate electrode to which the scan signal SCAN is applied, a first electrode to which the data signal DATA is applied, and a second electrode connected to the first electrode of the driving transistor TR1. The light emission control transistor TR3 can include a gate electrode to which the light emission signal EM is applied, a first electrode connected to the first electrode of the driving transistor TR1, and a second electrode connected to the light emission unit 420-1.

The initialization voltage supply unit 460-1 can provide the initialization voltage VINT to the gate electrode of the driving transistor TR1 and the first electrode of the OLED. The initialization voltage supply unit 460-1 can include a gate initialization transistor TR4 and a diode initialization transistor TR5. Here, the gate initialization transistor TR4 can include a gate electrode to which a gate initialization signal GI is applied, a first electrode connected to the initialization voltage VINT, and a second electrode connected to the gate electrode of the driving transistor TR1. The diode initialization transistor TR5 can include a gate electrode to which the diode initialization signal DI is applied, a first electrode connected to the initialization voltage VINT, and a second electrode connected to the first electrode of the OLED.

The boost capacitor CB can be connected between the gate electrode of the driving transistor TR1 and the first electrode of the OLED. The boost capacitor CB can boost the voltage level of the gate electrode of the driving transistor TR1 by the change of the voltage level of the first electrode of the OLED.

The data applying transistor TR2 can apply the data signal DATA to the gate electrode of the driving transistor TR1 when the scan signal SCAN is activated. The storage capacitor CS can maintain the voltage level of the gate electrode of the driving transistor TR1 while the scan signal SCAN is deactivated. The driving transistor TR1 can determine the light emission current IE based at least in part on the voltage level of the gate electrode when the light emission signal EM is activated. The light emission control transistor TR3 can control the light emission of the OLED based at least in part on the light emission signal EM.

The gate initialization transistor TR4 can provide the initialization voltage VINT to the gate electrode of the driving transistor TR1 based at least in part on the gate initialization signal GI. The voltage difference of the two electrodes of the storage capacitor CS can be initialized to a specific value ELVDD-VINT. The diode initialization transistor TR5 can provide the initialization voltage VINT to the first electrode of the OLED based at least in part on the diode initialization signal DI.

The OLED included in the first structure 400-1 and the OLED included in the second structure 400-2 can be substantially simultaneously turned on by boosting the voltage level of the gate electrode of the driving transistor TR1 by the boost capacitor CB. Thus, the color-shifting phenomenon can be prevented.

Figure 8:
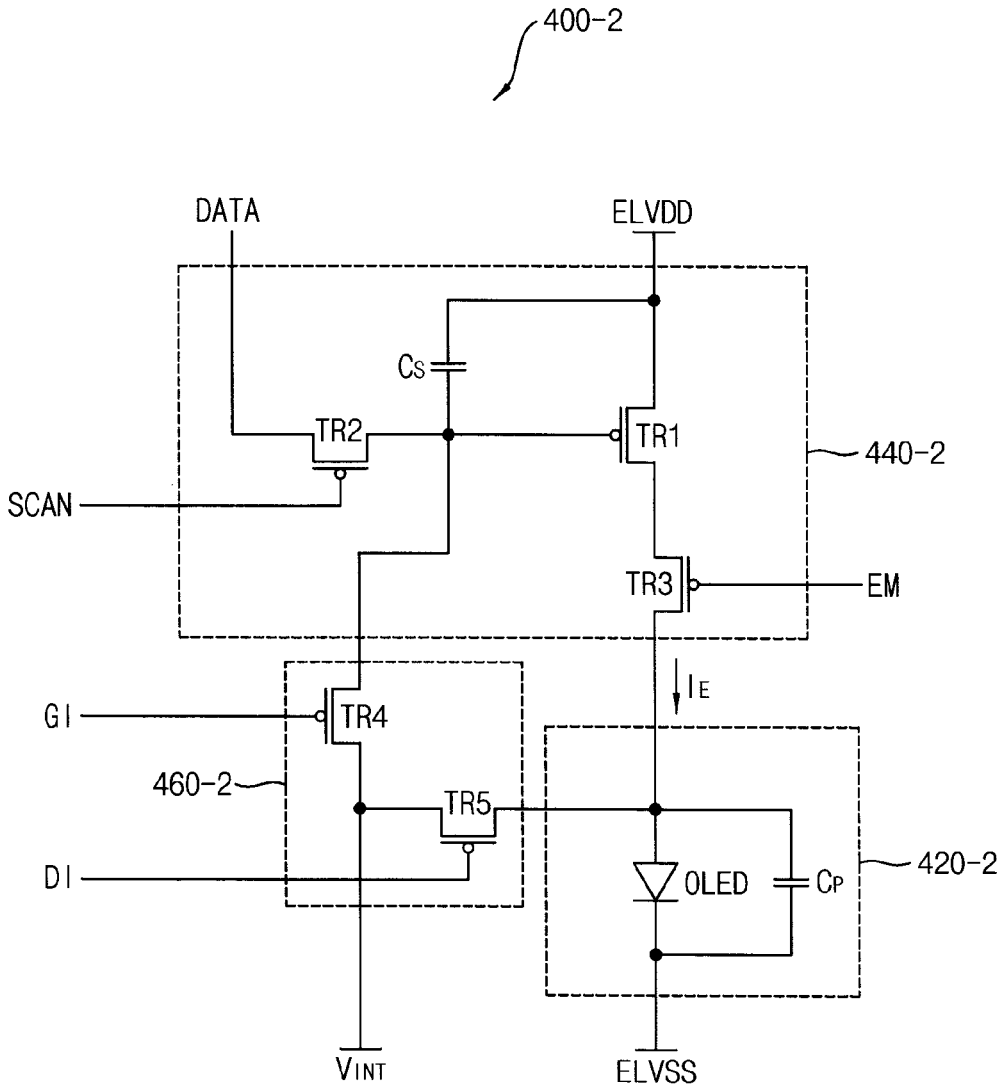
FIG. 8 is a circuit diagram illustrating another example of the second structure of FIG. 2.

FIG. 8 is a circuit diagram illustrating another example of the second structure 200-2 of FIG. 4.

Referring to FIG. 8, the second structure 400-2 includes a light emission unit 420-2, a light emission current applying unit 440-2, and an initialization voltage supply unit 460-2.

The light emission unit 420-2 can include an OLED which emits light based at least in part on a light emission current IE. Here, the OLED can include a first electrode connected to the light emission current applying unit 440-2 and a second electrode connected to a first power supply voltage (ELVSS). In example embodiments, the light emission unit 420-2 also includes a parallel-to-diode capacitor CP connected between the first and second electrodes of the OLED.

The light emission current applying unit 440-2 can apply the light emission current IE to the light emission unit 420-2. The light emission current applying unit 440-2 can include a driving transistor TR1, a storage capacitor CS, a data applying transistor TR2, and a light emission control transistor TR3. Here, the driving transistor TR1 can include a gate electrode, a first electrode, and a second electrode connected to a second power supply voltage ELVDD. The storage capacitor CS can be connected between a second power supply voltage ELVDD and a gate electrode of the driving transistor TR1. The data applying transistor TR2 can include a gate electrode to which the scan signal SCAN is applied, a first electrode to which the data signal DATA is applied, and a second electrode connected to the first electrode of the driving transistor TR1. The light emission control transistor TR3 can include a gate electrode to which the light emission signal EM is applied, a first electrode connected to the first electrode of the driving transistor TR1, and a second electrode connected to the light emission unit 420-2.

The initialization voltage supply unit 460-2 can provide the initialization voltage VINT to the gate electrode of the driving transistor TR1 and the first electrode of the OLED. The initialization voltage supply unit 460-2 can include a gate initialization transistor TR4 and a diode initialization transistor TR5. Here, the gate initialization transistor TR4 can include a gate electrode to which a gate initialization signal GI is applied, a first electrode connected to the initialization voltage VINT, and a second electrode connected to the gate electrode of the driving transistor TR1. The diode initialization transistor TR5 can include a gate electrode to which the diode initialization signal DI is applied, a first electrode connected to the initialization voltage VINT, and a second electrode connected to the first electrode of the OLED.

The data applying transistor TR2 can apply the data signal DATA to the gate electrode of the driving transistor TR1 when the scan signal SCAN is activated. The storage capacitor CS can maintain the voltage level of the gate electrode of the driving transistor TR1 while the scan signal SCAN is deactivated. The driving transistor TR1 can determine the light emission current IE based at least in part on the voltage level of the gate electrode when the light emission signal EM is activated. The light emission control transistor TR3 can control the light emission of the OLED based at least in part on the light emission signal EM.

The gate initialization transistor TR4 can provide the initialization voltage VINT to the gate electrode of the driving transistor TR1 based at least in part on the gate initialization signal GI. The voltage difference of the two electrodes of the storage capacitor CS can be initialized to a specific value ELVDD-VINT. The diode initialization transistor TR5 can provide the initialization voltage VINT to the first electrode of the OLED based at least in part on the diode initialization signal DI.

As described above, although a display panel and an OLED display according to exemplary embodiments have been described with reference to FIGS. 1 through 8, the described technology is not limited thereto. Thus, it can be modified and changed by those skilled in the art without departing from the technical spirit of the described technology. For example, although the light emission current applying unit is described above, the light emission current applying unit is not limited thereto.

The described technology can be applied to an electronic device including an OLED display. For example, the described technology can be applied to computers, laptops, digital cameras, video camcorders, cellular phones, smartphones, smartpads, portable multimedia players (PMPs), personal digital assistants (PDAs), MP3 players, navigation systems, video phones, monitoring systems, tracking systems, motion sensing systems, image stabilizing systems, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display panel for an organic light-emitting diode (OLED) display, the display panel comprising:

a first pixel configured to emit a first color of light;

a second pixel configured to emit a second color of light; and a third pixel configured to emit a third color of light, wherein each of the first to third pixels includes:

a light emission current applying unit including a driving transistor and a storage capacitor, wherein a gate electrode of the driving transistor is configured to receive a data signal from a display driver of the OLED display;

a light emission unit configured to emit light based at least in part on a light emission current, wherein the light emission unit includes an OLED including a first electrode electrically connected to the light emission current applying unit and a second electrode electrically connected to a first power supply voltage, wherein the light emission current applying unit is configured to apply the light emission current to the light emission unit, wherein the driving transistor of the light emission current applying unit is configured to determine an amount of the light emission current based at least in part on a voltage level of the data signal, and wherein the storage capacitor is configured to maintain the voltage level of the data signal for a predetermined time; and an initialization voltage supply unit configured to provide an initialization voltage to the gate electrode of the driving transistor and the first electrode of the OLED, wherein each of the first and second pixels further includes a boost capacitor directly connected to the gate electrode of the driving transistor and the first electrode of the OLED.

2. The panel of claim 1, wherein the first pixel includes a red pixel configured to emit red light, and wherein the second pixel includes a blue pixel configured to emit blue light.

3. The panel of claim 1, wherein the boost capacitor is configured to boost a voltage level of the gate electrode of the driving transistor based on a change of a voltage level of the first electrode of the OLED.

4. The panel of claim 1, wherein the light emission unit is configured to not emit light while the storage capacitor maintains a voltage level for displaying black color corresponding to a (0)th gray-level.

5. The panel of claim 4, wherein the light emission unit further includes a parallel-to-diode capacitor electrically connected between the first and second electrodes of the OLED.

6. The panel of claim 5, wherein the parallel-to-diode capacitor includes a parasitic capacitor electrically connected between the first and second electrodes of the OLED.

7. The panel of claim 1, wherein the light emission current applying unit is further configured to apply i) the data signal to the gate electrode of the driving transistor when a scan signal is activated and ii) the light emission current to the light emission unit when a light emission signal is activated.

8. The panel of claim 7, wherein the light emission current applying unit further includes:

a data applying transistor including a gate electrode configured to receive the scan signal, a first electrode configured to receive the data signal, and a second electrode electrically connected to a first electrode of the driving transistor, wherein the storage capacitor is electrically connected between a second power supply voltage and the gate electrode of the driving transistor;

a voltage compensation transistor including a gate electrode configured to receive the scan signal, a first electrode electrically connected to a second electrode of the driving transistor, and a second electrode electrically connected to the gate electrode of the driving transistor;

a first light emission control transistor including a gate electrode configured to receive the light emission signal, a first electrode electrically connected to the second power supply voltage, and a second electrode electrically connected to the first electrode of the driving transistor; and a second light emission control transistor including a gate electrode configured to receive the light emission signal, a first electrode electrically connected to the second electrode of the driving transistor, and a second electrode electrically connected to the light emission unit.

9. The panel of claim 7, wherein the light emission current applying unit includes:

a data applying transistor including a gate electrode configured to receive the scan signal, a first electrode configured to receive the data signal, and a second electrode electrically connected to the gate electrode of the driving transistor, wherein a second electrode of the driving transistor is electrically connected to a second power supply voltage, and wherein the storage capacitor is electrically connected between the second power supply voltage and the gate electrode of the driving transistor; and a light emission control transistor including a gate electrode configured to receive the light emission signal, a first electrode electrically connected to a first electrode of the driving transistor, and a second electrode electrically connected to the light emission unit.

10. The panel of claim 1, wherein the initialization voltage supply unit is further configured to provide i) the initialization voltage to the gate electrode of the driving transistor when a gate initialization signal is activated and ii) the initialization voltage to the first electrode of the OLED when a diode initialization signal is activated.

11. The panel of claim 10, wherein the initialization voltage supply unit includes:

a gate initialization transistor including a gate electrode configured to receive the gate initialization signal, a first electrode electrically connected to the initialization voltage, and a second electrode electrically connected to the gate electrode of the driving transistor; and a diode initialization transistor including a gate electrode configured to receive the diode initialization signal, a first electrode electrically connected to the initialization voltage, and a second electrode electrically connected to the first electrode of the OLED.

12. The panel of claim 1, wherein the initialization voltage supply unit comprises i) a gate initialization transistor having a gate electrode configured to receive a gate initialization signal and ii) a diode initialization transistor having a gate electrode configured to receive a diode initialization signal, and wherein the gate and diode initialization signals are different.

13. An organic light-emitting diode (OLED) display comprising:

a display panel including first to third pixels configured to respectively emit first to third colors of light;

a data driver configured to transmit a plurality of data signals to the display panel;

a scan driver configured to transmit a plurality of scan signals to the display panel;

a light emission driver configured to transmit a plurality of light emission signals to the display panel; and a timing controller configured to control the data driver, the scan driver, and the light emission driver, wherein each of the first to third pixels includes:

a light emission current applying unit including a driving transistor and a storage capacitor, wherein a gate electrode of the driving transistor is configured to receive a data signal from a display driver of the OLED display;

a light emission unit configured to emit light based at least in part on a light emission current, wherein the light emission unit includes an OLED including a first electrode electrically connected to the light emission current applying unit and a second electrode electrically connected to a first power supply voltage, wherein the light emission current applying unit is configured to apply the light emission current to the light emission unit, wherein the driving transistor of the light emission current applying unit is configured to determine an amount of the light emission current based at least in part on a voltage level of the data signal, and wherein the storage capacitor is configured to maintain the voltage level of the data signal for a predetermined time; and an initialization voltage supply unit configured to provide an initialization voltage to the gate electrode of the driving transistor and the first electrode of the OLED, wherein each of the first and second pixels further includes a boost capacitor directly connected to the gate electrode of the driving transistor and the first electrode of the OLED.

14. The display of claim 13, wherein the first pixel includes a red pixel configured to emit red light, and wherein the second pixel includes a blue pixel configured to emit blue light.

15. The display of claim 13, wherein the boost capacitor is configured to boost a voltage level of the gate electrode of the driving transistor based on a change of a voltage level of the first electrode of the OLED.

16. The display of claim 13, wherein the light emission unit is configured to not emit light while the storage capacitor maintains a voltage level for displaying black color corresponding to a (0)th gray-level.

17. The display of claim 16, wherein the light emission unit further includes a parallel-to-diode capacitor electrically connected between the first and second electrodes of the OLED.

18. The display of claim 13, wherein the light emission current applying unit is further configured to apply i) the data signal to the gate electrode of the driving transistor when a selected scan signal is activated, and ii) the light emission current to the light emission unit when a light emission signal is activated.

19. The display of claim 18, wherein the light emission current applying unit further includes:

a data applying transistor including a gate electrode configured to receive the selected scan signal, a first electrode configured to receive the data signal is applied, and a second electrode electrically connected to a first electrode of the driving transistor, wherein the storage capacitor is electrically connected between a second power supply voltage and the gate electrode of the driving transistor;

a voltage compensation transistor including a gate electrode configured to receive the selected scan signal, a first electrode electrically connected to a second electrode of the driving transistor, and a second electrode electrically connected to the gate electrode of the driving transistor;

a first light emission control transistor including a gate electrode configured to receive the light emission signal, a first electrode electrically connected to the second power supply voltage, and a second electrode electrically connected to the first electrode of the driving transistor; and a second light emission control transistor including a gate electrode configured to receive the light emission signal, a first electrode electrically connected to the second electrode of the driving transistor, and a second electrode electrically connected to the light emission unit.

20. The display of claim 13, wherein the initialization voltage supply unit is further configured to provide i) the initialization voltage to the gate electrode of the driving transistor when a gate initialization signal is activated and ii) the initialization voltage to the first electrode of the OLED when a diode initialization signal is activated.

21. The display of claim 20, wherein the initialization voltage supply unit includes:

a gate initialization transistor including a gate electrode configured to receive the gate initialization signal, a first electrode electrically connected to the initialization voltage, and a second electrode electrically connected to the gate electrode of the driving transistor; and a diode initialization transistor including a gate electrode configured to receive the diode initialization signal, a first electrode electrically connected to the initialization voltage, and a second electrode electrically connected to the first electrode of the OLED.

* * * * *